US007213595B2

(12) United States Patent
Capon et al.

(10) Patent No.: US 7,213,595 B2
(45) Date of Patent: May 8, 2007

(54) MULTI-STAGE RESPIRATOR FILTER WITH TIM FILTER OPTION

(75) Inventors: Andrew Capon, Salisbury (GB); David K. Friday, Hunt Valley, MD (US); David W. Pike, Salisbury (GB)

(73) Assignee: Avon Protection Systems, Inc., Cadillac, MI (US)

( * ) Notice: Subject to any disclaimer, the term of this patent is extended or adjusted under 35 U.S.C. 154(b) by 451 days.

(21) Appl. No.: 10/604,497

(22) Filed: Jul. 25, 2003

(65) Prior Publication Data

US 2007/0056589 A1 Mar. 15, 2007

Related U.S. Application Data

(62) Division of application No. 10/257,801, filed as application No. PCT/US01/12545 on Apr. 17, 2001, now Pat. No. 6,860,267.

(60) Provisional application No. 60/198,012, filed on Apr. 18, 2000.

(51) Int. Cl.
*A62B 18/08* (2006.01)

(52) U.S. Cl. ..... 128/205.27; 128/206.12; 128/206.17; 128/201.25

(58) Field of Classification Search ..... 128/206.15, 128/206.16, 206.17, 205.27, 205.28, 205.29, 128/201.25; 55/DIG. 33, DIG. 35, 315, 55/342, 482, 485; 96/133, 134, 136, 147
See application file for complete search history.

(56) References Cited

U.S. PATENT DOCUMENTS 923,776 A * 6/1909 Danielewicz ..... 128/206.15
2,227,959 A * 1/1941 Cover ..... 96/131
2,744,523 A * 5/1956 Malcom, Jr. et al. ... 128/206.17
2,744,524 A * 5/1956 Whipple ..... 128/206.17
3,142,549 A 7/1964 Klusewitz et al.
4,088,461 A * 5/1978 Brauer ..... 96/147
4,548,626 A * 10/1985 Ackley et al. ..... 96/139
4,714,486 A * 12/1987 Silverthorn ..... 96/134
4,850,346 A 7/1989 Michel et al.
4,867,770 A * 9/1989 Feeney ..... 96/137
4,921,512 A 5/1990 Maryyanek et al.
5,038,775 A * 8/1991 Maruscak et al. ..... 128/205.27
5,158,077 A * 10/1992 Sundstrom ..... 128/205.27
5,240,479 A * 8/1993 Bachinski ..... 96/17
5,595,910 A * 1/1997 Kant et al. ..... 435/289.1
5,651,810 A * 7/1997 Flaherty et al. ..... 95/287
5,660,173 A 8/1997 Newton (Continued)

FOREIGN PATENT DOCUMENTS

DE 692 545 6/1940

(Continued)

*Primary Examiner*—Justine Yu
(74) *Attorney, Agent, or Firm*—McGarry Bair PC

(57) ABSTRACT

A filter canister assembly for a gas mask comprising a primary canister with a first filter medium adapted to remove aerosols, particulate materials and droplets from air and a second filter medium comprising an adsorbent filter medium adapted to remove toxic gases and arranged in serial communication with the first filter medium in the first canister. A supplementary filter canister has a third filter media adapted to intercept toxic industrial materials and is removably mounted to a first end of the first housing to supplement the ability of the primary filter canister to filter toxic industrial gases.

13 Claims, 12 Drawing Sheets

U.S. PATENT DOCUMENTS 5,776,213 A * 7/1998 Flaherty et al. ..... 55/482
5,776,287 A * 7/1998 Best et al. ..... 156/260
5,797,974 A * 8/1998 Flaherty et al. ..... 55/482
5,996,580 A * 12/1999 Swann ..... 128/206.17
6,146,449 A * 11/2000 Lee et al. ..... 96/117.5
6,176,239 B1 1/2001 Grove et al.
6,340,024 B1 * 1/2002 Brookman et al. .... 128/201.25
6,467,481 B1 * 10/2002 Eswarappa ..... 128/206.17

FOREIGN PATENT DOCUMENTS

FR 1 158 291 6/1958
GB 516 268 12/1939

* cited by examiner

MULTI-STAGE RESPIRATOR FILTER WITH TIM FILTER OPTION

CROSS REFERENCE TO RELATED APPLICATIONS

This application is a divisional of U.S. patent application Ser. No. 10/257,801, filed Oct. 15, 2002, now U.S. Pat. No. 6,860,267, issued Mar. 1, 2005, which claims priority on International Application No. PCT/US01/12545, filed Apr. 17, 2001, which claims the benefit of U.S. Provisional Application Ser. No. 60/198,012, filed Apr. 18, 2000.

BACKGROUND OF INVENTION

1. Field of the Invention

The invention relates to gas mask filters. In one of its aspects, the invention relates to a gas mask with removable filtration cartridges. In another of its aspects, the invention relates to multi-stage filtration cartridges with an optional TIM filter. In another of its aspects, the invention relates to a gas mask with twist and lock removable filtration cartridges.

2. Description of the Related Art

It is traditional for combination filters such as those used in industry or by the military to have two filter media in sequence: firstly, a particulate filter to remove solid or liquid aerosols, droplets and particulate matter such as dusts, smokes, bacteria and viruses; and secondly an adsorbent layer, usually an activated charcoal to remove gases and vapors. A wide variety of charcoals with or without impregnants are available for particular filtration applications. The charcoal adsorbent may have more than one type of charcoal in intermixed or filled as separate layers into the filter body. See, for example, U.S. Pat. No. 5,660,173, issued Aug. 26, 1997 to Newton.

Military canisters typically have two types of media, particulate and charcoal. The charcoal is impregnated with such metallic salts of Cu, Cr, Ag, Zn, Mo and triethylenediamine in order to broaden the scope of chemical filtration by including both physical adsorption and chemical interaction with the impregnants to remove those chemicals that are poorly adsorbed and retained by physical adsorption alone. See, for example, the Grove et al. U.S. Pat. No. 6,176,239, issued Jan. 23, 2001, which incorporates by reference the U.S. patents to Braun et al. U.S. Pat. Nos. 5,033,465 and 5,078,132.

Attempts have heretofore been made to develop a filter medium that has the capability to remove both particulate matter and to adsorb gases. See, for example, British Specification No. 516,268, published Dec. 28, 1939. These filters are often referred to as "intimate mix" filters. One very good example of this type of filter was the "Cheekpad" design of filters used in the U.S. Military M17 Mask. However, it was found that the filtration efficiency of such media was compromised for both chemicals and for particulates. As a result, these types of filters are not in use today.

Each filter has a lifespan that relates to the amount and type of filter media. When any of the filter types have been saturated, the filter canister must be replaced. Thus, the life of any canister is only as long as the weakest filter medium. It is possible to construct a filter canister with sufficient amounts of each of the filter media to give a long life for all types of gases. However, the cost, size and weight of the canister must be taken into account in selecting the amounts of filter media that is to be incorporated into each canister. In addition, breathing resistance increases as the amount of the filter material increases. For military purposes, the canisters must be relatively small and light in weight. Yet, the canisters must be able protect the soldier from the exotic as well as the ordinary gases to which the average combatant might reasonably be subjected. Ordinarily, military personnel rarely face industrial gases and the addition of filter material to remove significant amounts of industrial gases is for the most part unnecessary. However, these gases must be filtered when they are encountered in the field, however infrequently. Thus, a balance must be struck between maximum protection against all types of gasses, weight, breathing resistance and bulk. These compromises have been made with smaller canisters that are replaceable when spent. The canister must be easily and quickly replaced so that a spent canister can be discarded and a new one added.

U.S. Pat. No. 4,850,346 to Michel et al. discloses a bayonet-type respirator fitting for a respirator port in a gas mask. The inhalation port includes an inhalation valve formed of a resilient membrane or flap, and mounts a chemical cartridge by a bayonet-type mount. The chemical cartridge can further mount a filter retainer housing a mechanical filter such as a felted fibrous disk.

British Specification No. 516,268 discloses a gas mask cartridge in which the air flows through a felted filtering mass comprising homogeneous mixture of a fibrous material adapted for mechanical filtration and substances capable of absorbtive and adsorbtive removal of noxious components in an air stream passing though the cartridge. The cartridge is made of layers of filter material that are axially stacked with radial passages from a central conduit for parallel axial flow through the filter media.

SUMMARY OF INVENTION

According to the invention, a filter canister assembly for a gas mask comprises a primary filter canister with an inlet opening at a first end and an outlet at a second end. A first filter medium is mounted in the primary filter canister in communication with the primary filter canister inlet opening and is adapted to remove aerosols, particulate materials and droplets from air passing through the first filter canister. A second filter medium that is adapted to remove toxic gases is arranged in serial communication with the first filter medium in the primary filter canister and with the outlet opening in the first filter canister. A supplementary filter canister has an inlet opening at a first end and an outlet opening at a second end and the supplementary filter canister second end is removably mounted to the primary filter canister first end so that the primary filter canister inlet opening is in communication with the supplementary filter canister outlet opening. A third filter media is adapted to filter toxic industrial materials and is mounted in said supplementary filter canister in communication with the inlet and outlet openings in the second filter canister. The first and second filter media are capable of filtering out contaminants in normal hostile environments and the third filter medium is adapted to supplement any ability of the first and second filter media to filter toxic industrial materials from the gasses passing through the first and second filter canisters.

The primary canister filters have a broad spectrum capability to remove particulate materials in gases as well as gases that are poorly adsorbed in the physical adsorption process. However, in order to keep the weight and breathing resistance through the filter and mask as low as possible, the mass of charcoal used in the filters is limited and does not give significant protection against some TIMs. On the other hand, it is very effective in dealing with the military chemical warfare gases such as cyanogens chloride and hydrogen chloride.

The third filter media is used to boost protection against TIMs. Filter median for TIMs are well known and can include activated charcoal or can be some other alternative adsorbent such as a porous polymer, alumina or molecular sieve material that will remove TIMs.

In one embodiment, the first and second filter media are mounted in axially stacked relationship and a barrier is mounted between the first and second filter medium to force air entering the canister through the inlet opening from a central portion of the first filter medium in a radial direction through the first filter medium to an outer portion thereof, then axially to an outer portion of the second filter medium, then radially through the second filter medium to a central portion of the second filter medium to the outlet opening of the housing.

Preferably, the third filter medium is a particulate filter and a sorbent filter that is adapted to remove TIMs. In one embodiment, the first filter medium comprises a pleated paper. The second filter medium comprises an adsorbent carbon filter medium, preferably that includes metallic salts that interact with contaminant gases.

DETAILED DESCRIPTION

Figure 1:
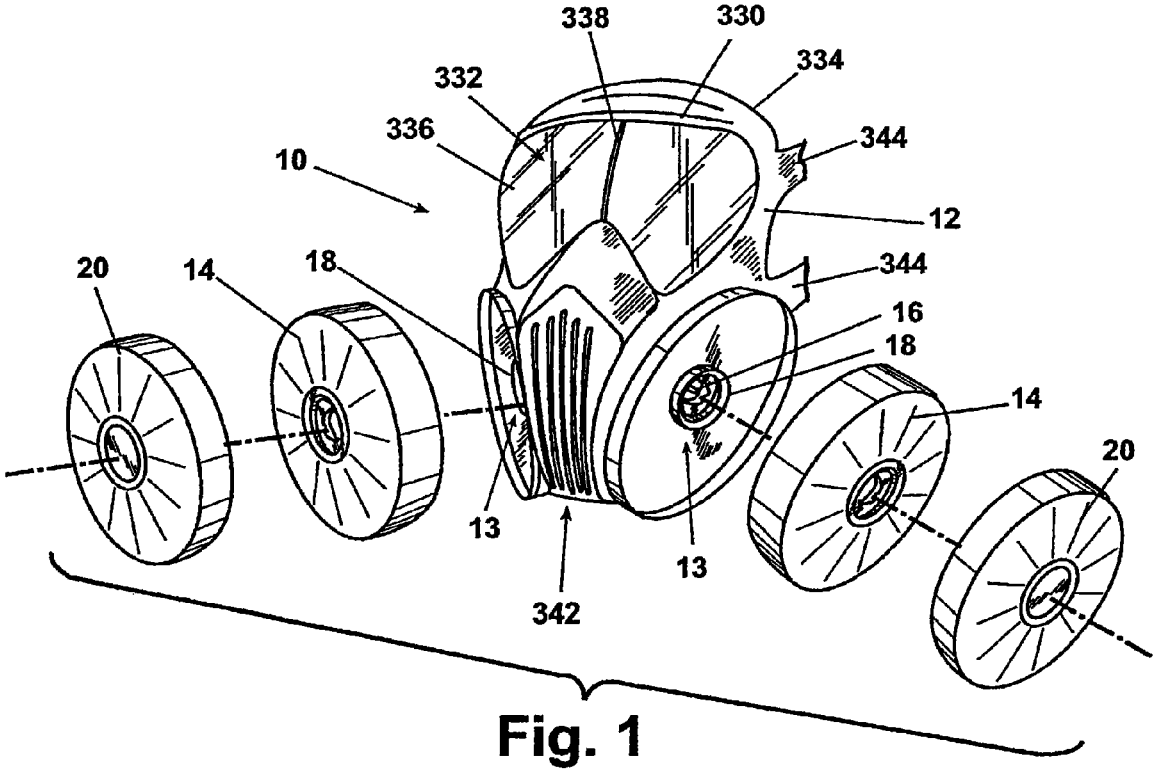
FIG. 1 is an exploded perspective view of a gas mask and filter assembly according to the invention.

A gas mask and filter assembly 10 according to the invention is shown in the drawings, beginning with FIG. 1. The assembly 10 comprises a mask housing 12 that fits onto the users face and defines an interior chamber, and a primary filter canister 14 and a supplemental filter canister 20. The housing 12 comprises a pair of circular or elliptical canister mounts 13 including an inlet port assembly and self-sealing mechanism 16 and twist-and-lock connector 18 (shown without detail) for affixing circular or elliptical filter canisters 14 to mask housing 12.

Housing 12 further comprises a facepiece 330 and a visor 332. In a preferred embodiment, facepiece 330 is constructed in multiple sizes of a butyl-rich polymer or other polymer or polymer blend such as butyl/silicone material that will provide the desired level of resistance to penetration of toxic chemicals and will be readily de-contaminated.

The facepiece 330 further includes a face seal (not shown) that is also injection molded in a separate co-molding process using a silicone-rich polymer or other polymer or polymer blend that is comfortable for the user and forms an effective seal on the face. In this concept, the outer materials would be selected for chemical agent resistance, decontamination, low set, low flammability, mechanical strength and long-term durability. The seal material would be selected for high level of comfort, low skin toxicity, high flexibility at low temperature and the ability to conform closely to facial features. The materials would have to have acceptable bond strength. In concept, it would be possible to bond polymer-to-polymer, polymer to blend, or blend to blend as necessary.

In an alternative embodiment, the facepiece and seal can be constructed of from the same polymer or polymer blend in a single injection molding operation. The face seal is an in-turned periphery 334 of facepiece 330 and including a built-in chin cup (not shown) for correct location on the user's face. In another embodiment, face piece 330 is constructed solely of one type of elastomeric material, such as butyl rubber or a blend of silicone and butyl rubber.

Visor 332 comprises a panel 336, constructed for example of polyurethane and configured to give maximum visibility and flexibility to the user, and providing close eye relief. In the depicted embodiment, the visor 332 further includes an elastomeric central hinge 338, although the visor 332 can be formed without a central hinge. The visor 332 should provide ballistic protection and be configured to receive outserts (not shown) to provide sunlight and laser protection. The visor 332 can further include an anti-scratch surface.

The panel 336 must be acceptable for light transmission, haze and reflectivity and must be resistant to the effects of exposure to chemical contaminants and decontaminants. The panel 336 must also have acceptable performance against impact, and be resistant to other challenges such as scratches or abrasions. In general, optical quality materials such as cast or injection-molded polyurethane or polycarbonate are suitable for the visor panel 336.

The hinge 338 should have adequate tensile strength and should be sufficiently flexible to withstand repeated flexing even at low temperatures (−32 C). Hinge 338 materials must bond to the panel 336 materials, must not take a set during storage, and should preferably be transparent. Polyurethane, styrene butadiene styrene, styrene ethylene butadiene styrene and some vulcanized or thermoplastic materials are suitable hinge materials.

Figure 17:
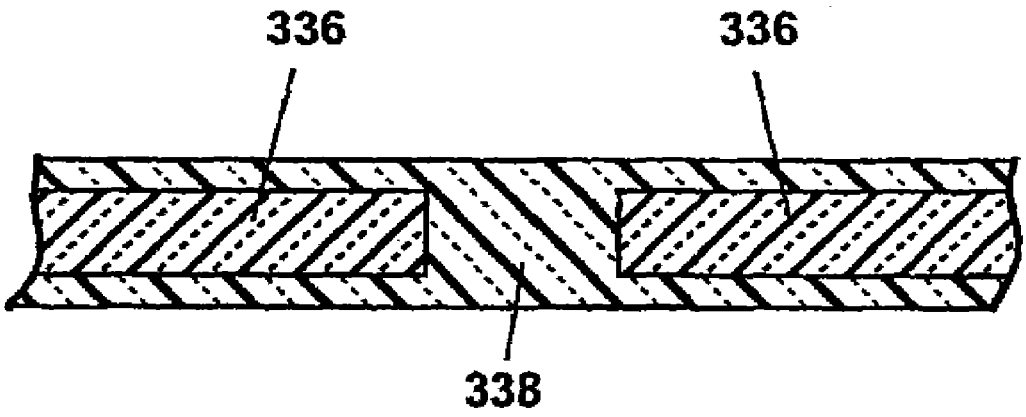
FIG. 17 is a partial cross-sectional view of a visor hinge formed by complete encapsulation.
Figure 18:
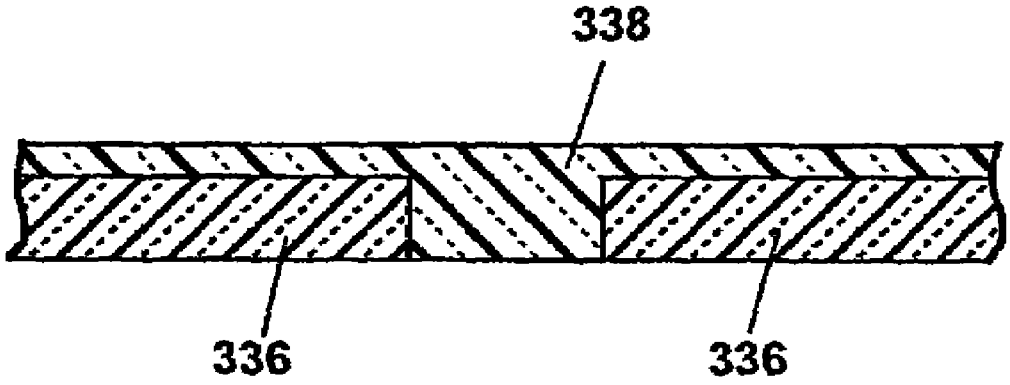
FIG. 18 is a partial cross-sectional view of a visor hinge formed by lamination.

The hinge 338 and panel 336 may be joined together by chemical bonding in a two-part process, or may be adhesively bonded as a post-process operation. The hinge 338 may also be formed as a mechanical hinge, a molded joint, a living hinge or by reduction in the cross-sectional area of the material. The hinge 338 may be formed by complete encapsulation (see FIG. 17) or lamination (see FIG. 18) or the joint between the materials may be made by a form of welding technology using laser, ultrasonic, infra-red or radio frequency (RF) induction.

Housing 12 further comprises a primary speech module 342 that combines the functions of speech, drinking system, and outlet valve assembly. The shape of the primary speech module is acoustically formed to eliminate the need for a speech diaphragm. The inlet and outlet valves are interchangeable, reducing the number of unique spare parts required. Housing 12 is held to a user's face by a plurality of low-profile harness straps 344 defining a flat brow-seal that eliminates hot spots and fits comfortably with a helmet. Harness straps 344 fold over exterior of housing 12 to aid user in rapidly donning mask 10. The interior chamber of housing 12 further comprises a nose cup (not shown) that is formed of a suitable material such as silicone or polyisoprene and is provided in multiple sizes for comfort and fit on different users. The nose cup also acts as an air guide to eliminate misting of the visor 332.

Referring to FIGS. 2–6, inlet port assembly and self-sealing inhalation mechanism 16 comprises a raised perimeter wall 60, a central cavity 62 having a wall comprising a frusto-conical seating 66, a plug 64 having a central depending post 76 and a chamfered face 65, and a spring 28. Central cavity 62 terminates at a lower portion in a central hub 70 and a plurality of radial spokes 72. The hub 70 is connected to the wall of the cavity 62 by the spokes 72, and further includes a central recess 74 for receiving depending post 76 of valve plug 64. Post 76 is further received within spring 28, the spring 28 being interposed between the hub 70 and plug 64 to bias plug 64 away from the hub 70 and against the seating 66. Hub 70 further comprises a depending stud 82 for receiving a resilient inhalation valve 68. Valve 68 is generally umbrella-shaped and includes an annular dome-shaped portion 80 and a perimeter edge 84.

The inlet port assembly 16 is received in an opening formed in the mask housing 12 and includes a circumferential channel 17 for sealingly receiving the edge of the mask housing 12 circumscribing the opening.

Figure 7:
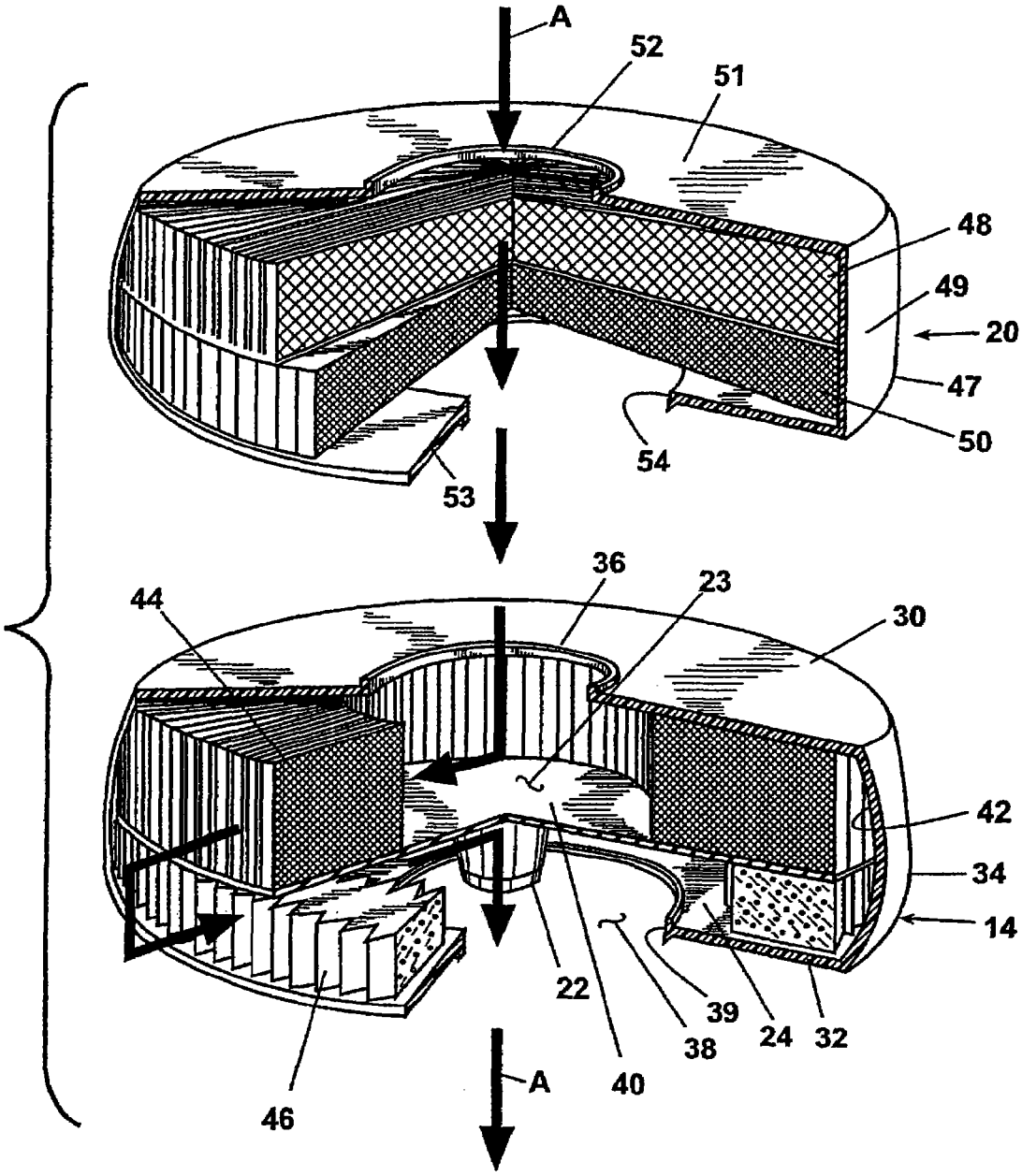
FIG. 7 is exploded cut-away perspective view of the filter assembly used in the gas mask of FIGS. 1–6.

Referring now to FIG. 7, the filter canister 14 comprises a stacked radial-flow configuration. The canister 14 comprises a hollow divided disk having opposing inlet and outlet faces 30, 32 joined by an annular outside wall 34. The opposing faces 30, 32 each have one of a central inlet and outlet opening 36, 38. The canister 14 further comprises a dividing wall 40 parallel to the opposing faces 30, 32, fluidly isolating the inlet and outlet openings 36, 38 except for an annular passage 42 formed adjacent to the interior of the annular outside wall 34 because the dividing wall 40 is smaller in diameter than the annular outside wall 34. An inlet cavity 23 is formed between the dividing wall 40 and the inlet opening 36. The inlet cavity 23 is surrounded by an annular array of a particulate filtration medium, such as a W-pleated fiberglass paper 44, completely filling the space between the inlet face 30 of the cartridge 14 and the dividing wall 40, except for the annular passage 42. An outlet cavity 24 is formed between the dividing wall 40 and the outlet opening 38, and is surrounded by an annular carbon filter 46, likewise completely filling the space between the outlet face 32 and the dividing wall 40, except for the annular passage 42. A projection 22 extends perpendicularly from the dividing wall 40 into the center of the outlet cavity 24, approaching the level of the outlet face 32. The fiberglass paper 44 is a high efficiency filtration medium to remove aerosols, particulate materials and droplets from contaminated air, and is herein disclosed as a W-pleated paper, but other particulate filtration media are contemplated, including electrostatically-charged fibers in pleated, rosette or pad configurations. The carbon filter 46 is disclosed as a "cookie cutter" surface configuration, and is depicted as an immobilized adsorption bed, but use of a granular adsorbent, in more cylindrical configurations and single or multiple layers of adsorbent, is also contemplated. The carbon filter 46 is further contemplated as a charcoal adsorbent bed impregnated with metallic salts for chemical interaction with those gases, such as cyanogen chloride and hydrogen cyanide, which are poorly adsorbed by physical adsorption processes.

The central outlet opening 38 of the outlet face 32 is bordered by a perimetric rim 39 having an internal diameter closely approximating the external diameter of the perimeter wall 60 of the inlet port assembly 16. Filter canister 14 and inlet port assembly 16 are configured to interlock in a twist-and-lock connection, as is well known to ordinary workers in the gas mask industry.

As further illustrated in FIG. 7, the assembly 10 includes add-on filter 20 that can be use to filter out toxic industrial materials (TIM). Filter 20, as a supplemental filter, is selectable depending on contaminant conditions, and filter 14 is effective, without supplement, in many hostile environments. Filter 20 is disclosed as an axial-flow filter, but a radial-flow filter is also contemplated. Filter 20 includes an outer case 47 enclosing a first, particulate layer 48 and a second, adsorbent layer 50 separated by a permeable membrane 49. Filter 20 further includes an inlet face 51 having a central inlet opening 52, and an outlet face 53 having a central outlet opening 54. The inlet and outlet openings 52, 54 are fluidly connected through the first and second layers 48, 50 and membrane 49. A second twist-and-lock connector (not shown), is used to releasably mount filter 20 to filter 14 and to form a fluid-tight seal between the outlet opening 54 of filter 20 and the inlet opening 36 of filter canister 14.

Figure 2:
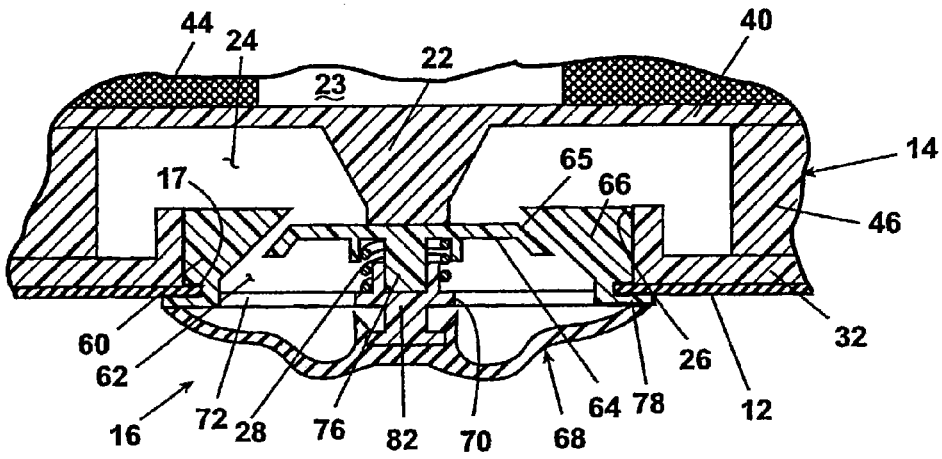
FIGS. 2–4 are a partial cross-sectional view of the gas mask and filter assembly of FIG. 1, with a filter canister mounted to an inlet port assembly on the gas mask, during progressive stages of the inhalation cycle.
Figure 3:
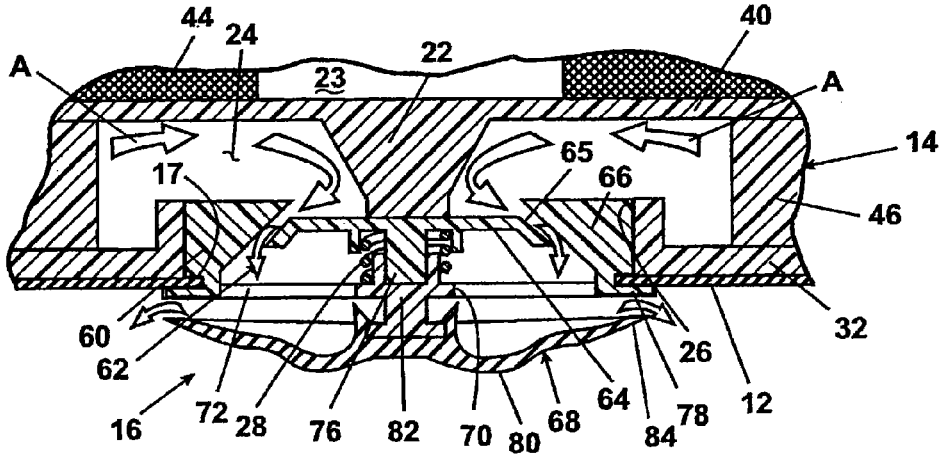
Figure 4:
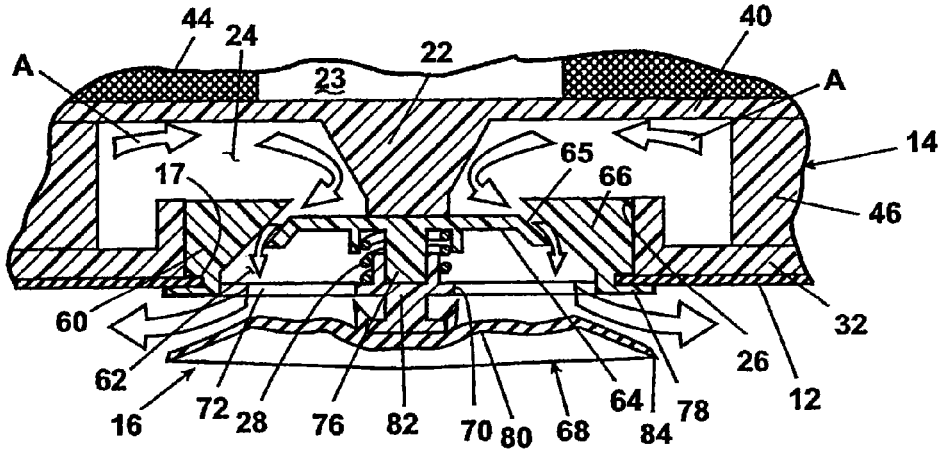

As the filter canister 14 is drawn toward the mask housing 12 by the twist-and-lock connector, the projection 22 bears against the plug 64, overcoming the bias of the spring 28 and opening the seal between plug 64 and the seating 66. FIGS. 2–4 illustrate the self-sealing mechanism 16 in the open position, wherein the canister 14 has been mounted on the inlet port assembly 16 and the projection 22 has depressed the plug 64 against the bias of spring 28. In FIG. 2, the user is exhaling, as evidenced by the valve 68 being in a flush seating against rear face 78. The flow of air A in FIG. 3 shows a low-level air flow, from the cavity 24 through the inlet port assembly 16, and then by a partially open inhalation valve 68, wherein the perimetric edge 84 is separated from rear face 78 to permit air flow, but valve 68 still retains its general umbrella shape with respect to mechanism 16. FIG. 4 illustrates a further state of valve 68, wherein an increased opening pressure developed by the user has inverted valve 68, further separating edge 84 from rear face 78 to provide a larger channel for air flow. The unique cross section of valve 68 allows it to invert under expected opening pressures to provide a greater air channel, while retaining internal biasing forces that return valve 68 to its original umbrella-like shape to form a seal against rear face 78 upon reduction of the inhalation air flow of the user.

Figure 5:
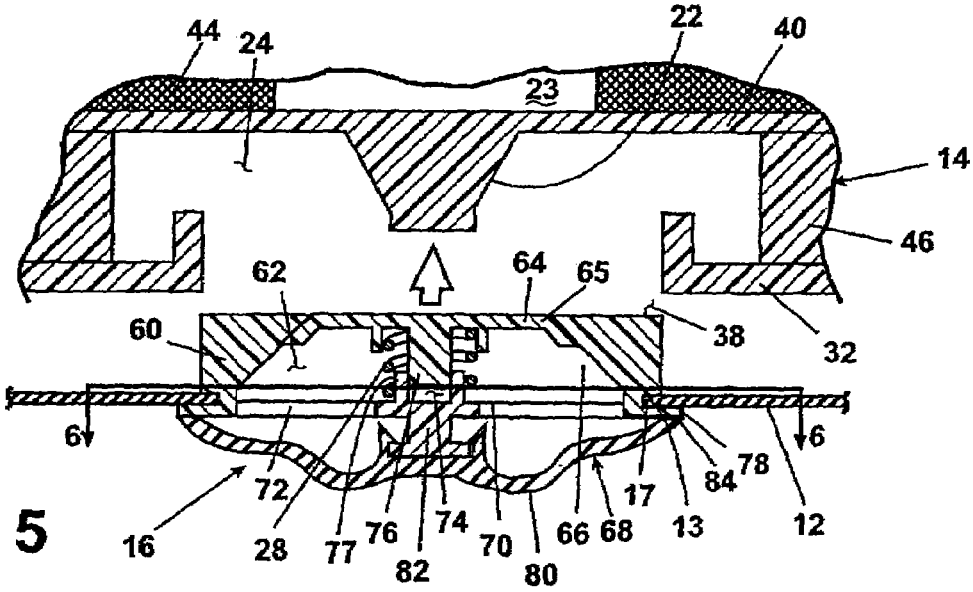
FIG. 5 is a partial cross-sectional view of the gas mask and filter assembly of FIGS. 1–4 with the canister of FIG. 2 removed from the inlet port assembly.
Figure 6:
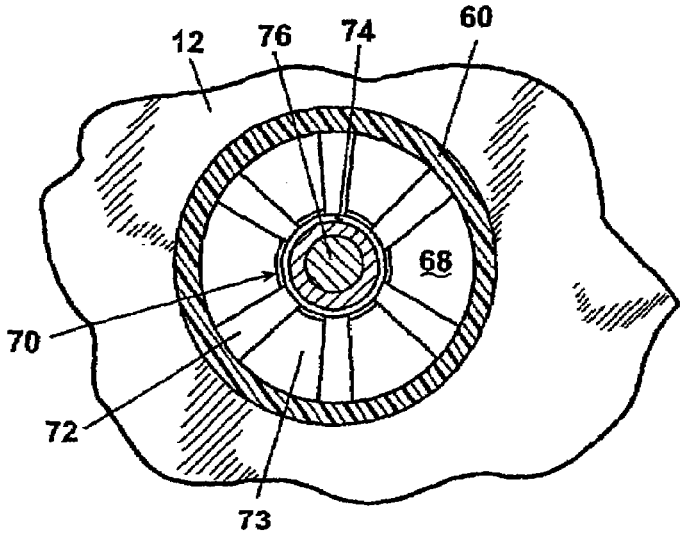
FIG. 6 is a cross-sectional view taken through line 6—6 of FIG. 5.

FIG. 5 illustrates the mechanism 16 with canister 14 removed. Spring 28 biases plug 64 away from hub 70 and into sealing engagement with seating 66. Spring 28 is selected to afford ready mounting of the canister 14, but of sufficient strength to maintain plug 64 in sealing engagement with seating 66 against any opening pressure developed by the user with canister 14 removed, thereby preventing inadvertent inhalation of unfiltered air.

The assembly 10 can function with the canister 14 alone mounted to canister mount 13, thereby opening self-sealing mechanism 16, but in those field situations where threat conditions warrant, the canister 14 is supplemented by filter 20. The flow of air A through the combined filter assembly canister 14 and filter 20 is shown in FIG. 7, wherein contaminated air enters filter 20 through inlet opening 52, passes axially through the layers 48, 50 and membrane 49, and exits through outlet opening 54 to enter the corresponding central inlet opening 36 of the canister 14. The air in the inlet opening 36 then flows radially outwardly through the fiberglass paper 44 to the annular passage 42, downwardly in the annular passage 42 to the outside of the carbon filter 46, radially inwardly through the carbon filter 46 to the cavity 24, to exit the filter 14 through the central outlet opening 38.

The stacked, radial-flow filter provides a greater surface area through which intake air can flow compared to the overall size of the filter. The consequence of increasing the surface area of the particulate and charcoal elements is to increase protection while reducing resistance to airflow in as small a space envelope as possible. This concept compares favorably with the current design of military axial flow filters. The stacked radial-flow filter has the additional advantage of having a central cavity that can contain the projection of the canister mount and inlet port assembly according to the invention, further maintaining a reduced spatial envelope for the mask and filter assembly. The concept is not, however, to be construed as only compatible with a radial-flow filter, as it is adaptable for use with other filter canister types, including axial-flow filters, and other connection types including bayonet and screw-thread mountings, and such use is contemplated.

Figure 8:
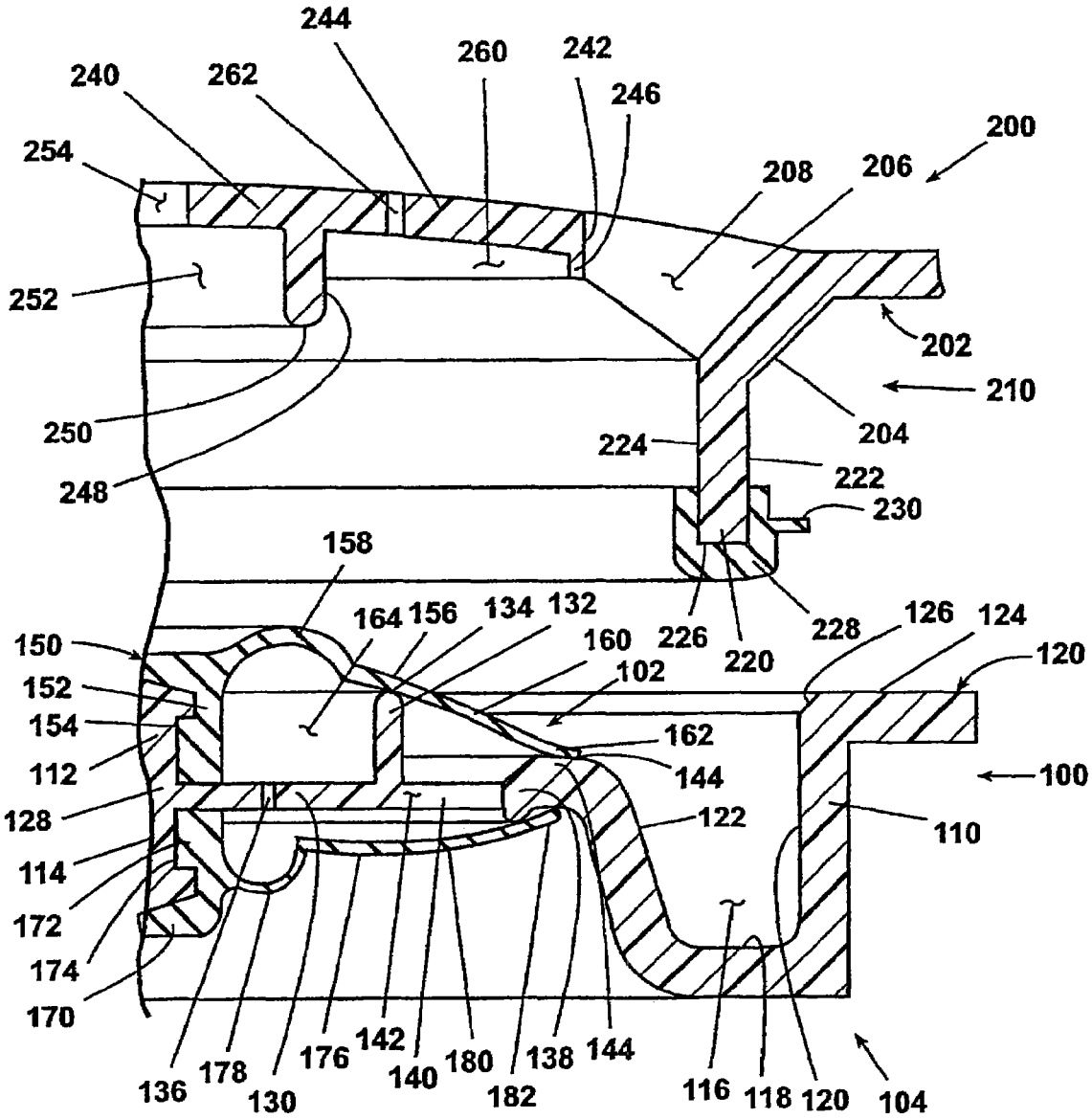
FIG. 8 is a partial cross-sectional view of a preferred embodiment of an inlet port assembly with a self-sealing valve and a filter canister in spaced relationship from the canister mount.
Figure 9:
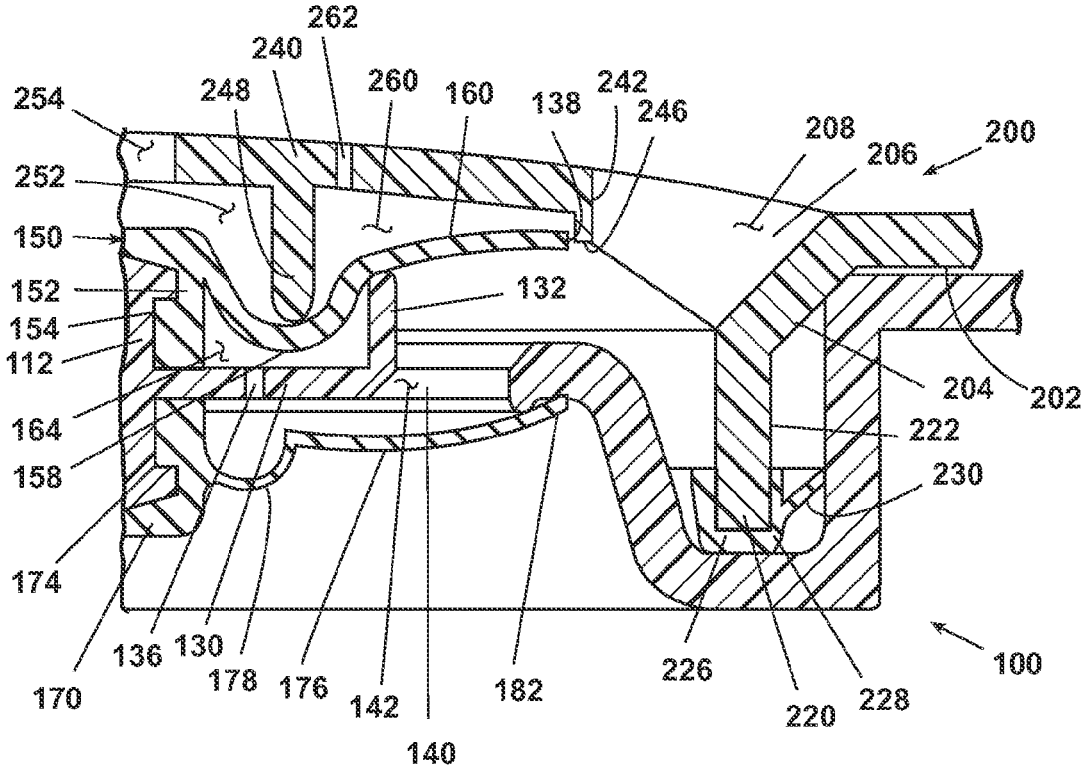
FIG. 9 is a partial cross-sectional view like FIG. 8 with a filter canister installed.

Referring now to FIGS. 8–12, a second embodiment of the self sealing valve 100 comprises a valve body 110, a resilient self sealing diaphragm 150, and a resilient inhalation diaphragm 170. Although only a half of the self sealing valve 100 is shown in FIGS. 8 and 9, the other side is a mirror image of the half shown in these drawings. Self sealing valve 100 has an outer face 102 and an inner face 104, the inner face 104 adapted to face the interior chamber of the gas mask 12.

The self-sealing diaphragm 150 is arranged on an outer face of the valve body 110, mounted on a stud 112. The inhalation diaphragm 170 is arranged on an interior face of valve body 110, mounted on a stud 114.

Valve body 110 includes an annular channel 116 having a bottom surface 118, an outer wall 120, and an inner wall 122. Valve body 110 further includes an annulus 124 projecting outwardly from an upper end of channel outer wall 120. The upper end of channel outer wall 120 includes an annular chamfer 126 at an upper end 138. Valve body 110 further defines at an interior portion thereof a hub 128 comprising a planar portion 130, the studs 112, 114, and an upstanding annular rib 132 between the hub 128 and the inner wall 122. The rib 132 includes an upper annular surface 134. Planar portion 130 further comprises a number of pressure relief holes 136 passing therethrough. The rib 132 is connected to an upper end 138 of inner wall 122 of channel 116 by a plurality of spokes 140, defining a number of open passages 142 therebetween. Inner wall 122 further comprises a sealing surface 144 at upper end 138.

The self-sealing diaphragm 150 includes a substantially cylindrical central portion 152 and an umbrella-like outer portion 156 integrally formed with the central portion 152. Central portion 152 includes a cavity 154 for receiving stud 112 and attaching diaphragm 150 to hub 128. Outer portion 156 includes a convex hinge portion 158 positioned between the central portion 152 and radially inwardly of rib 132. Outer portion 156 includes an annular skirt 160 having an outer edge 162 for forming a seal in cooperation with sealing surface 144. Skirt 160 is further arranged to contact or be in close proximity to the upper annular surface 134 of rib 132.

Diaphragm 150 and hub 128 define therebetween a cavity 164 fluidly connected with relief holes 136.

Inhalation diaphragm 170 includes a substantially cylindrical central portion 172 and an outer portion 176. Central portion 172 includes a cavity 174 for receiving stud 114 to connect inhalation diaphragm 170 to hub 128. Outer portion 176 includes a convex hinge 178 and a skirt 180. Skirt 180 includes an outer portion 182 arranged to form a seal with upper end 138 of inner wall 122.

A filtration canister 200 comprises an annular lower face 202 which includes an interface 210 for fluidly and sealingly connecting the filter element of the filtration canister 200 to the self sealing valve 100. The interface 210 comprises a first depending annular rib 220 and a central hub 240. Lower face 202 includes an annular chamfer portion 204 connecting outer surface 222 of the rib 220 with lower face 202.

Rib 220 includes an outer surface 222, an inner surface 224 and an end 226. An annular resilient seal 228 encapsulates end 226 of rib 220. Resilient seal 228 is, for example, made of elastomeric material, and includes a tongue 230 projecting radially outwardly from seal 228.

Hub 240 is connected to chamfer portion 204 by a plurality of spokes 206 and centered within the annular rib 220. An air passage 208 is defined between spokes 206 and between an outer edge 242 of hub 240 and chamfer portion 204. The air passage communicates with the filter medium in the filtration canister 200.

Hub 240 is substantially in the form of the disk 244 having a depending annular lip 246 at outer edge 242. Hub 240 further comprises a depending annular rib 248 having a tip 250. Annular rib 248 defines a cavity 252 fluidly connected through a relief passage 254 to the interior of filtration canister 200. A shallow cavity 260 is defined between lip 246 and rib 248 and is fluidly connected through relief holes 262 to the interior of filtration canister 200.

In the arrangement shown in FIG. 8, wherein filtration canister 200 is removed from self sealing valve assembly 100, any attempt to pass a gas in either direction through the self sealing valve assembly 100 will be stopped by the self sealing diaphragm 150 or the inhalation diaphragm 170. When installed on the gas mask 12, inhalation by the wearer of the gas mask 12 might dislodge the inhalation diaphragm 170, but will only draw the self sealing diaphragm 150 into closer contact with the valve body 110 preventing the inhalation of outside air. Exhalation by the wearer of the gas mask 12 will likewise press of the inhalation diaphragm 170 into closer contact with the valve body 110 to prevent passage of air.

Referring to FIG. 9, the filtration canister 200 is connected to the self sealing valve assembly 100, such that the interface 210 is inserted in the valve body 110 and opens the self sealing valve by displacing the self sealing diaphragm 150 from the sealing surface 144.

As the filtration canister interface 210 is placed over the self sealing valve assembly 100, the first portion of the interface 210 to contact the valve assembly 100 is the tongue 230 of the seal 228. As tongue 230 contacts outer wall 120 of channel 116, an effective seal is formed between interface 210 and valve body 110 such that the self-sealing diaphragm 150 is now fluidly isolated from the outside atmosphere. This fluid isolation is perfected as resilient seal 228 seats against the bottom surface 118 of channel 116.

Filtration canister 200 is lowered over self-sealing valve assembly 100 until chamfer portion 204 of filtration canister 200 abuts chamfer 126 of valve body 110. During this descent, tip 250 of rib 248 of filter interface 210 contacts convex hinge 158 of self-sealing diaphragm 150. Further descent of the filtration canister 200 causes of the rib 248 to depress convex hinge 158 of diaphragm 150, causing skirt portion 160 of diaphragm 150 to pivot about upper tip 134 of the rib 132, thereby lifting outer edge 162 away from sealing surface 144.

As shown in FIG. 9, with filter canister interface 210 fully inserted into self sealing valve assembly 100 outer edge 162 of self sealing diaphragm 150 is removed from sealing surface 144 and has been lifted into cavity 260 behind lip 246. Convex hinge 158 of self sealing diaphragm 150 is depressed into the cavity 164. During this process, any air trapped in cavity 164 has been released through relief holes 136, air trapped in cavity 260 has been released through relief holes 262 and air trapped in cavity 252 has escaped through relief passage 254.

With outer edge 162 of self sealing diaphragm 150 removed from sealing surface 144 and residing behind lip 246, air passages 208, 142 are fluidly connected and unobstructed. FIG. 9 shows the valve assembly 100 and a time when a wearer of the mask is not inhaling, specifically, there is no air flowing through the filtration canister 200 and through the self-sealing valve assembly 100.

Figure 10:
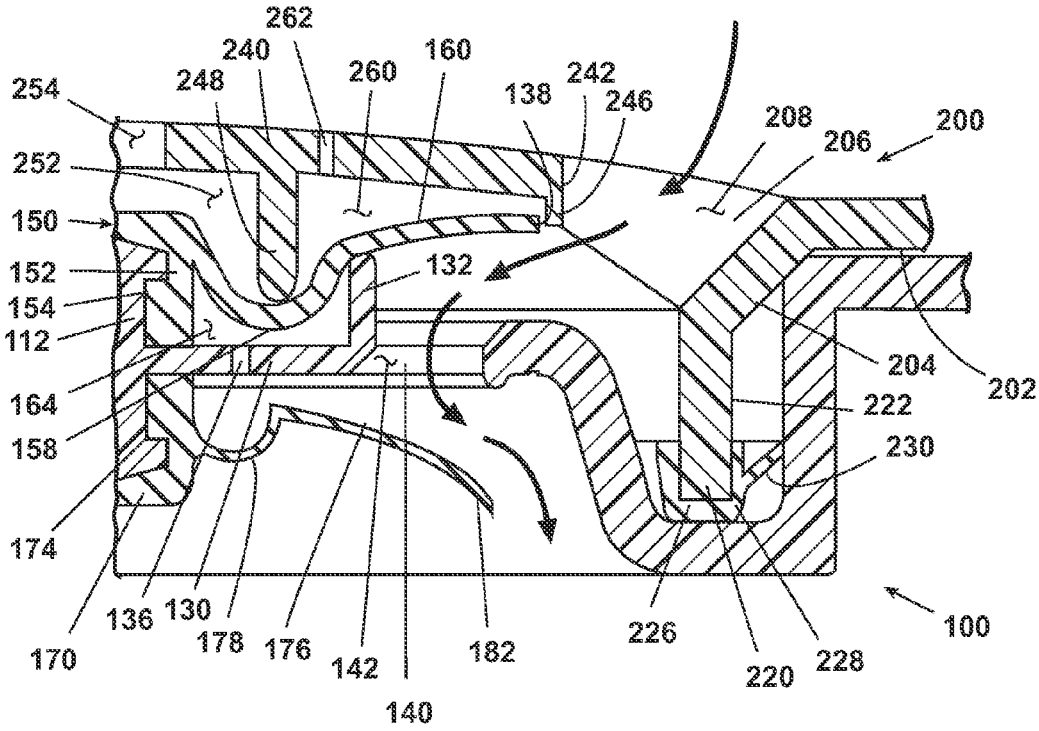
FIG. 10 is a partial cross-sectional view like FIG. 9 during an inhalation phase of operation of the mask.

Referring to FIG. 10, inhalation diaphragm 170 is being subjected to a negative pressure differential in the interior chamber of the mask 12, such as during inhalation by a wearer of the mask, flexing the inhalation diaphragm 170 about hinge 178 and separating the sealing relationship with upper end 138. Thus, a fluid passage is opened from the filtration canister 200 through air passages 208, 142 to the interior chamber of the mask as shown by the arrows.

The lip 246 performs a shielding function for the upper end 138 of the self-sealing diaphragm to divert the air passing through the passage 208. Thus, the air flows around the lip 246 and does not catch the upper end 138 of the self-sealing diaphragm and thereby tend to close the valve. The upper end 138 is thus positioned out of the flow path of the air that passes through the passage 208.

Figure 11:
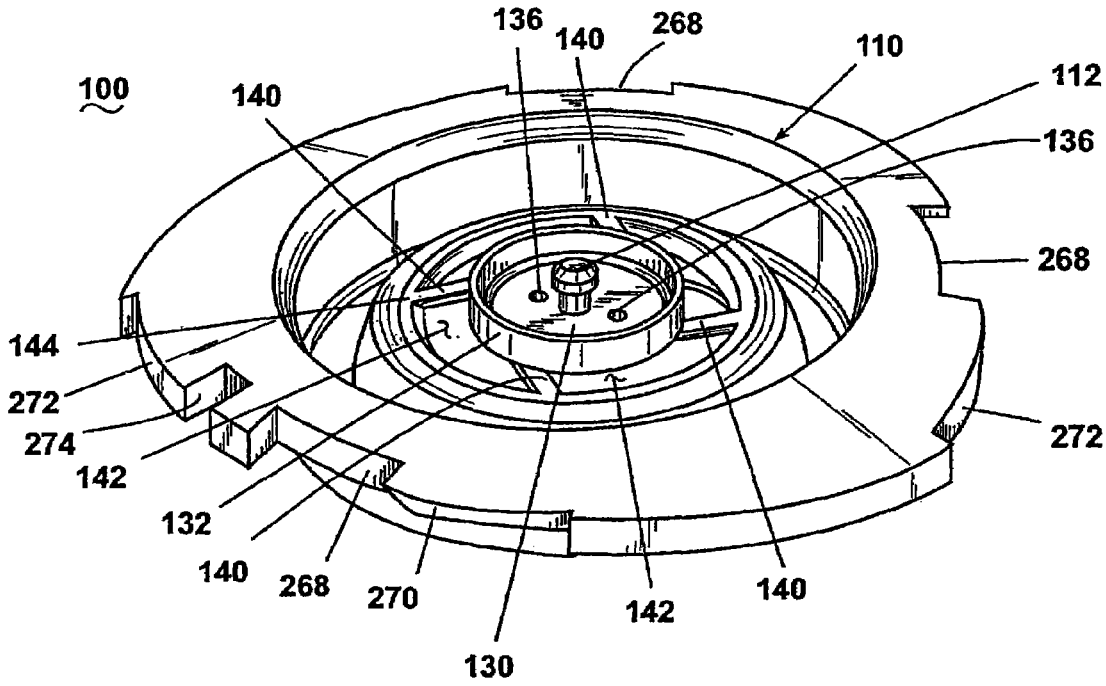
FIG. 11 is a perspective view of the self-sealing mechanism of FIGS. 8 and 9 with the self-sealing diaphragm removed for clarity.
Figure 12:
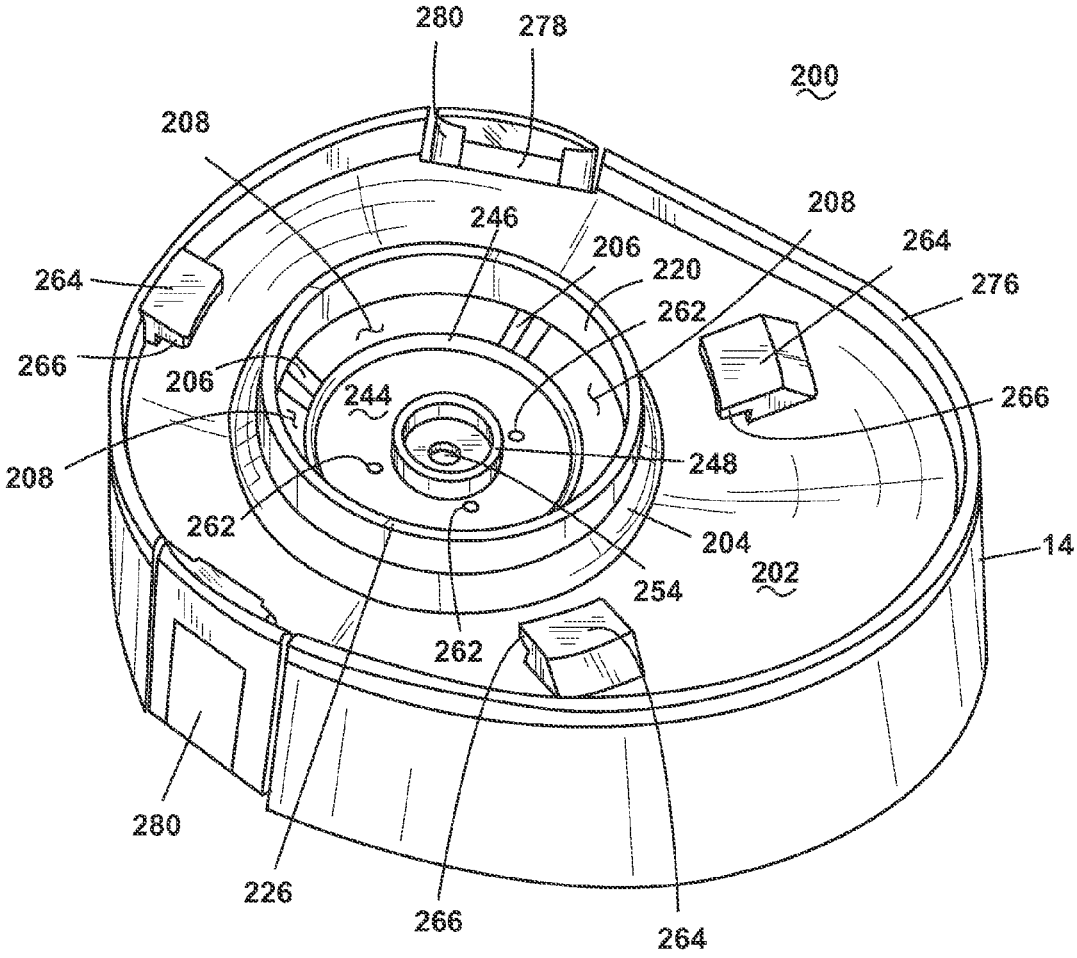
FIG. 12 is a perspective view of the filtration canister interface of the embodiment shown in FIGS. 8–10.
Figure 13:
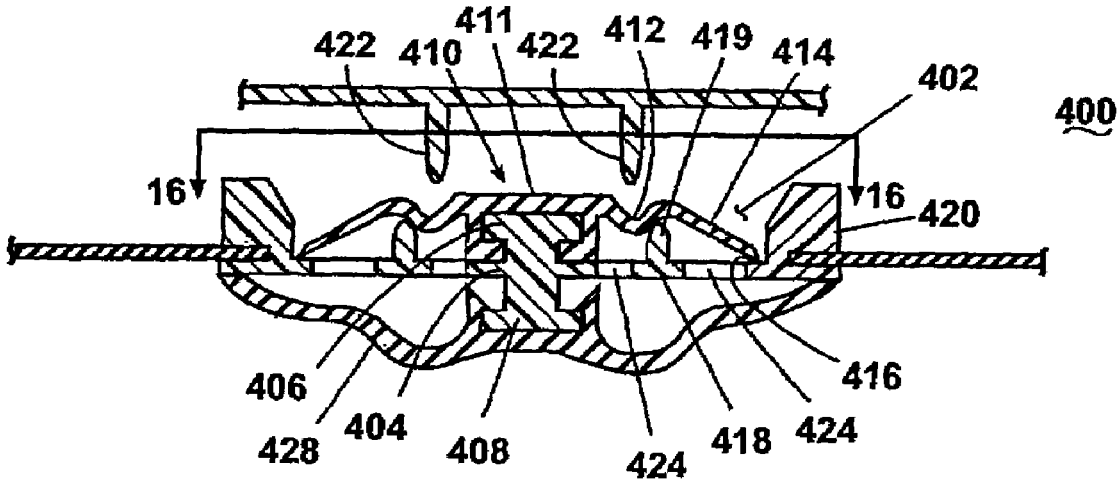
FIG. 13 is a partial cross-sectional view of a further embodiment of an inlet port assembly with a self-sealing valve and a filter canister in spaced relationship from the canister mount.
Figure 14:
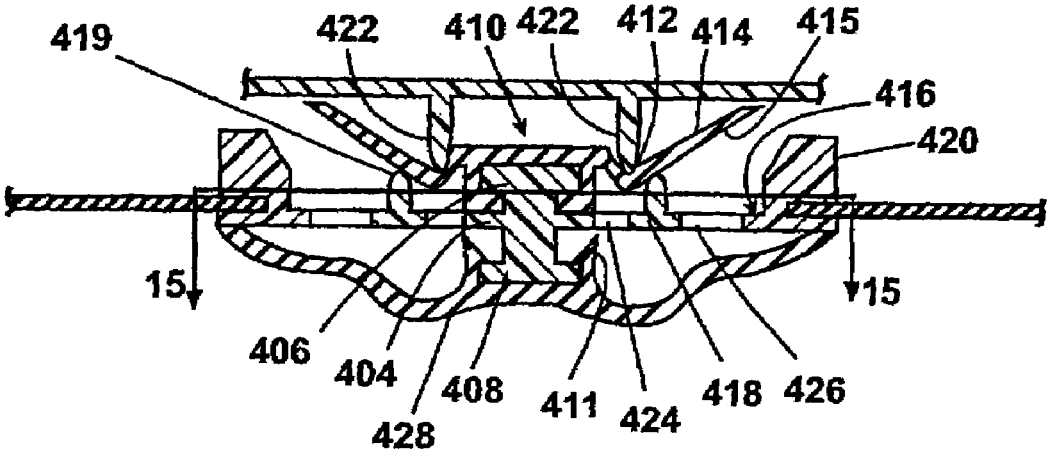
FIG. 14 is a partial cross-sectional view like FIG. 8 with a filter canister installed.
Figure 15:
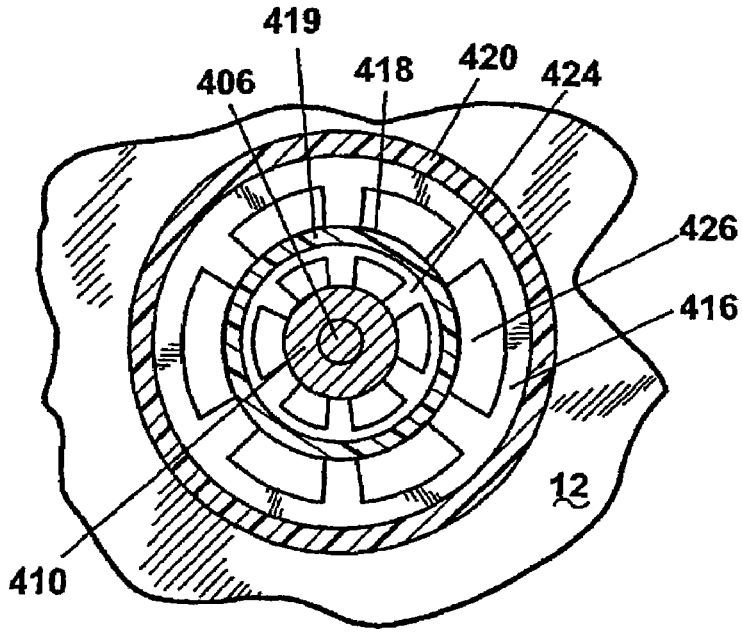
FIG. 15 is a partial cross-sectional view taken through line 15—15 of FIG. 14.
Figure 16:
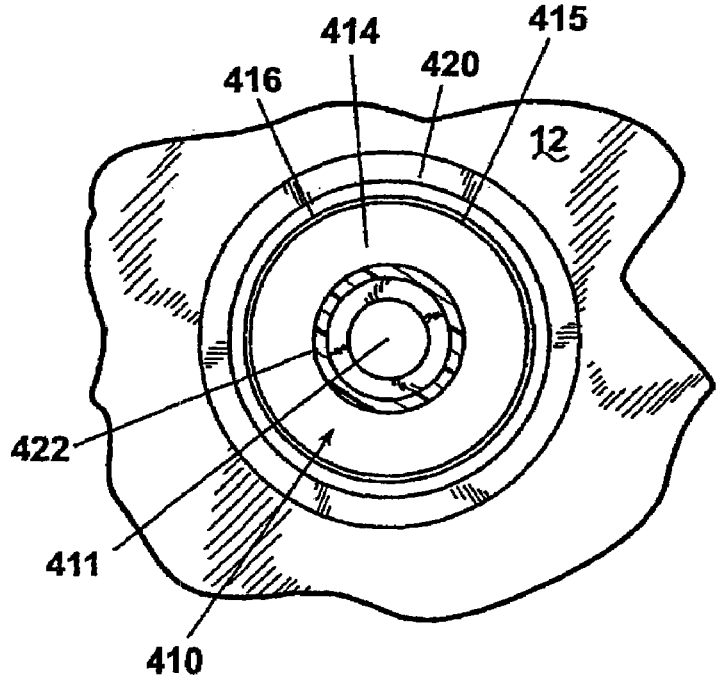
FIG. 16 is a partial cross-sectional view taken through line 16—16 of FIG. 13.

As illustrated in FIGS. 11 and 12, the filter canister 14 is elliptical in shape and has several lugs 264 with inwardly directed overhanging flanges 266 radially spaced about the relief passage 254. The valve body 110 has a circular shape with indentations 268 spaced about the outer periphery. The valve body 110 has ramps 270 adjacent each of the indentations 268. The outer periphery of the valve body is shaped to fit within the outer wall 276 of the filter canister 14. The indentations 268 are received within the lugs 264 and the projecting flanges 266 are adapted to slide beneath the ramps 270 as the canister is rotated counter-clockwise with respect to the facemask to tightly draw the canister against the facemask canister mount 13. Clips 280 are resiliently mounted to the canister 14 through integral flanges 278 to provide a grip for the user to rotate the canister onto and off of the facemask canister mount. An indentation 272 is further provided on the outer periphery of the valve body 110 for a slide lock (not shown) that seats in a radial slot 274.

A third embodiment of a self-sealing mechanism 400 according to the invention is shown is FIGS. 13–16. Mechanism 400 comprises a raised perimeter wall 420 having an inwardly projecting lip 416 and defining a central cavity 402 that terminates at a lower portion in a central hub 404 parallel to lip 416. Hub 404 and annular pivot ring 418 are centered in cavity 402 by a plurality of radial spokes 424 connecting hub 404 and pivot ring 418 to lip 416, spokes 424 further defining a plurality of radial openings 426 therebetween. Annular pivot ring 418 comprises an annular upstanding pivot rim 419 perpendicular to the pivot ring 418. Hub 404 further comprises opposing studs 406, 408, perpendicular to the plane defined as the bottom of cavity 402, for receiving conical seal 410 and resilient inhalation valve 428 respectively. Valve 428 is substantially as described above as valve 68 in FIGS. 2–6.

Seal 410 includes a central portion 411, an annular concave hinge portion 412, and a conical skirt portion 414 having a perimetric edge 415. The diameter of the hinge portion 412 is smaller than the diameter of pivot ring 418, so that with the seal 410 received on stud 406, centered in cavity 402, hinge portion 412 lies within pivot ring 418, and skirt portion 414 overlies pivot ring 418. Edge 415 is further configured to abut lip 416 in a sealing engagement, held in place by the material resilience of seal 410.

Self-sealing mechanism 400, as described, comprises a sealed opening, in that a user attempting to exhale through mechanism 400 is prevented from so doing by valve 428. Mechanism 400 is sealed against the user attempting to inhale, as any suction drawn within the mask draws skirt 414 inwardly, thereby increasing the seal between edge 415 and lip 416.

Mechanism 400 is used in conjunction with a filter having a complementary configuration comprising a projecting annular rim 422 having a diameter substantially conforming to the diameter of hinge portion 412. Rim 422 is configured to descend in alignment with hinge portion 412 as the filter is seated about mechanism 400. As rim 422 descends, it depresses hinge portion 412, forcing conical skirt portion 414 against upstanding annular pivot rim 419. Conical skirt portion 414 pivots about rim 419, lifting perimetric edge 415 upwardly and out of contact with lip 416, thereby exposing radial apertures 426. The user can then inhale by overcoming the opening pressure of valve 428.

While the invention has been specifically described in connection with certain specific embodiments thereof, it is to be understood that this is by way of illustration and not of limitation. Reasonable variation and modification are possible within the scope of the foregoing description and drawings without departing from the spirit of the invention.

The invention claimed is:

1. A filter canister assembly for a gas mask comprising:

a primary filter canister with an inlet opening at a first end and an outlet at a second end;

a first filter medium adapted to remove aerosols, particulate materials and droplets from air and mounted in the primary filter canister in communication with the primary filter canister inlet opening;

a second filter medium adapted to remove toxic gases and arranged in serial communication with the first filter medium in the primary filter canister and with the outlet opening in the first filter housing, whereby the first and second filter media are capable of filtering out contaminants in normal hostile environments; and a supplementary filter canister having an inlet opening at a first end and an outlet opening at a second end, the supplementary filter canister second end is removably mounted to the primary filter canister first end so that the primary filter canister inlet opening is in communication with the supplementary filter canister outlet opening; and a third filter media adapted to filter toxic industrial materials and mounted in said supplementary filter canister in communication with the inlet and outlet openings in the second filter canister.

2. A filter canister assembly for a gas mask according to claim 1 wherein the first and second filter media are mounted in axially stacked relationship and further comprising a barrier between the first and second filter medium to force air entering the canister through the inlet opening from a central portion of the first filter medium in a radial direction through the first filter medium to an outer portion thereof, then axially to an outer portion of the second filter medium, then radially through the second filter medium to a central portion of the second filter medium to the outlet opening of the housing.

3. A filter canister assembly for a gas mask according to claim 2 wherein the third filter medium comprises a particulate filter and an adsorbent filter.

4. A filter canister assembly for a gas mask according to claim 3 wherein the first filter medium comprises a pleated paper.

5. A filter canister assembly for a gas mask according to claim 4 wherein the second filter medium comprises an adsorbent carbon filter medium.

6. A filter canister assembly for a gas mask according to claim 5 wherein the second filter medium further includes metallic salts that interact with contaminant gases.

7. A filter canister assembly for a gas mask according to claim 1 wherein the third filter medium is a particulate filter and an adsorbent filter.

8. A filter canister assembly for a gas mask according to claim 1 wherein the first filter medium comprises a pleated paper.

9. A filter canister assembly for a gas mask according to claim 1 wherein the second filter medium comprises an adsorbent carbon filter medium.

10. A filter canister assembly for a gas mask according to claim 9 wherein the second filter medium further includes metallic salts that interact with contaminant gases.

11. A filter canister assembly for a gas mask according to claim 1 wherein the composition and amount of the third filter medium is adapted to boost the capability of the first and second filter media to filter TIMs from contaminated air.

12. A filter canister assembly for a gas mask according to claim 1 wherein at least one of the primary and supplementary filter canisters has an elliptical shape.

13. A filter canister assembly for a gas mask according to claim 12 wherein both of the primary and supplementary filter canisters have an elliptical shape.

* * * * *